US010571123B2

(12) United States Patent
Yamaguchi et al.

(10) Patent No.: US 10,571,123 B2
(45) Date of Patent: Feb. 25, 2020

(54) AIR SUPPLY AND EXHAUST ADAPTER FOR COMBUSTION APPARATUS

(71) Applicant: NORITZ CORPORATION, Hyogo (JP)

(72) Inventors: Hideki Yamaguchi, Kobe (JP); Masaki Sugatani, Kobe (JP); Toshihiko Hamagami, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 116 days.

(21) Appl. No.: 15/861,535

(22) Filed: Jan. 3, 2018

(65) Prior Publication Data

US 2018/0195720 A1 Jul. 12, 2018

(30) Foreign Application Priority Data

Jan. 6, 2017 (JP) ..... 2017-000878

(51) Int. Cl.
*F23J 13/04* (2006.01)
*F23J 11/00* (2006.01)

(52) U.S. Cl.
CPC ..... *F23J 13/04* (2013.01); *F23J 11/00* (2013.01); *F23J 2213/202* (2013.01); *F23J 2213/203* (2013.01); *F23J 2213/204* (2013.01)

(58) Field of Classification Search
CPC ..... F23J 13/04
See application file for complete search history.

(56) References Cited

U.S. PATENT DOCUMENTS 3,136,309 A * 6/1964 Martz ..... F24C 15/002 126/85 B
3,994,280 A * 11/1976 Winters ..... F23L 17/04 126/307 A
4,111,004 A * 9/1978 Blomberg ..... F23L 17/04 126/85 B
4,550,773 A * 11/1985 Martin ..... F24D 5/04 165/166

(Continued)

FOREIGN PATENT DOCUMENTS

JP 10002553 A * 1/1998
JP 2007285651 A * 11/2007
JP 5884865 B2 3/2016

*Primary Examiner* — Nathaniel Herzfeld
(74) *Attorney, Agent, or Firm* — Studebaker & Brackett PC

(57) ABSTRACT

In an air supply and exhaust adapter for a combustion device of a forced air supply and exhaust type, with the combustion device comprising an air supply section and an exhaust section being provided to project from a top plate portion of an outer casing; comprising a base portion that comprises a box shaped configuration and an open bottom portion, an air supply intake portion that is formed on the top surface portion of the base portion so as to cover the air supply section and to take in air from the surroundings of the combustion device, a circumferential wall portion that surrounds the periphery of the exhaust section; and a communication passage defined between the top surface portion and the top plate portion so as to communicate the space between the exhaust section and the circumferential wall portion with the air supply intake portion; the communication passage being constructed so that, due to the operation of the air blower means, the gauge pressure therein becomes negative.

3 Claims, 4 Drawing Sheets

(56) References Cited

U.S. PATENT DOCUMENTS

| | | | | |
|---|---|---|---|---|
| 5,628,629 | A * | 5/1997 | Mitani | F23C 9/003 432/180 |
| 6,029,614 | A * | 2/2000 | Kayahara | F22B 21/065 122/367.1 |
| 6,305,369 | B1 * | 10/2001 | Garloch | F23L 17/005 126/116 A |
| 9,459,007 | B2 * | 10/2016 | Warmuth | F23J 13/06 |
| 9,513,003 | B2 * | 12/2016 | Watanabe | F23L 11/02 |
| 2010/0089382 | A1 * | 4/2010 | Brown | F23L 17/04 126/307 A |
| 2015/0338127 | A1 * | 11/2015 | Kim | F23L 15/00 122/18.4 |

* cited by examiner

AIR SUPPLY AND EXHAUST ADAPTER FOR COMBUSTION APPARATUS

BACKGROUND OF THE INVENTION

The present invention relates to an air supply and exhaust adapter that is attached to an air supply aperture and to an exhaust aperture of a combustion device.

Conventionally, hot water supply devices and room heating devices have been widely used that perform hot water supply and/or space heating by employing natural exhaust type (CF: Conventional Flue type) combustion devices that are installed inside a building, and that combust fuel by taking in air from within the building and discharge the combustion exhaust gases to the exterior of the building by the force of natural venting. An exhaust pipe that communicates with the exterior is provided to the building, and, since the exhaust unit of the CF type combustion device is connected to the exhaust pipe, accordingly the combustion exhaust gases can be discharged to the exterior.

When a combustion device of this CF type is to be replaced with a new one, sometimes, from the viewpoint of maintaining the external appearance of the building, there are cases that it is not possible to remove an exhaust pipe that is already in existence. In such a case, one solution is to replace the combustion device by inserting a new exhaust pipe into the interior of the exhaust pipe that is already in existence.

For example, the exhaust construction for a combustion device of Japanese Patent Publication 5,884,865 is connected to an exhaust unit of a forced exhaust type (FE: Forced Exhaust type) combustion device that combusts fuel by forcibly sucking in air from the inside of the building with a blower fan, and that vents the resulting combustion exhaust gases to the outside. This exhaust construction makes it possible to discharge combustion exhaust gases to the outside by passing an exhaust conduit through the interior of an exhaust pipe that is already in existence, and also prevents the intrusion of rain water by disposing an air supply and exhaust adapter in the space between the exhaust pipe and the exhaust conduit. Moreover, this space is connected to a connection port that is provided on the outer casing of the combustion device, and, by utilizing the negative gauge pressure within the outer casing that is generated during operation of the blower fan, it becomes possible to send combustion exhaust gases that have leaked out into the space between the exhaust pipe and the exhaust conduit back into the combustion device for a second time.

However, when it is not possible to remove the already existing exhaust pipe, it is often not possible to provide a new air supply pipe. For this reason, it may not be possible to replace a CF type combustion device or an FE type combustion device with a forced air supply and exhaust type (FF: forced flue or forced draft balanced flue type) combustion device that sucks in outdoor air from an air supply pipe with a blower fan, combusts fuel, and discharges the exhaust to the exterior, which in recent years has become a mainstream type. Accordingly, it is necessary to provide a FE type combustion device as a replacement, and this constitutes a burden upon the supplier of combustion equipment.

Even if an FF type combustion device is installed by passing a new exhaust conduit through an exhaust pipe that is already in existence, so that air inside the building is sucked in and the exhaust gases are discharged to the exterior of the building, there is a danger that the exhaust gases may leak from the exhaust conduit to the interior of the building. Since, with the exhaust construction for a combustion device described in above patent publication, the space between the exhaust pipe and the exhaust conduit is connected to a connection port on the outer casing of an FE type combustion device in order to prevent leakage of the combustion exhaust gases into the building, accordingly, normally, this exhaust construction cannot be applied to an FF type combustion device that is not provided with any connection port of this type on its outer casing for introduction of outdoor air.

An object of the present invention is to provide an air supply and exhaust adapter which makes it possible to employ an FF type combustion device in a safe manner by utilizing an exhaust pipe that is already in existence, even in a site in which it is not possible to install an air supply pipe.

SUMMARY OF THE INVENTION

The present invention presents an air supply and exhaust adapter for a combustion device of a forced air supply and exhaust type, with the combustion device comprising an air supply section and an exhaust section being provided to project from a top plate portion of an outer casing; comprising a base portion that comprises a box shaped configuration and an open bottom portion, an air supply intake portion that is formed on a top surface portion of the base portion so as to cover the air supply section and that moreover takes in air from a surroundings of the combustion device, a circumferential wall portion that surrounds a periphery of the exhaust section, and a communication passage defined between the top surface portion and the top plate portion so as to communicate a space between the exhaust section and the circumferential wall portion with the air supply intake portion; the communication passage being constructed so that, due to an operation of the air blower means, a gauge pressure therein becomes negative.

According to the structure described above, an FF type combustion device to which this air supply and exhaust adapter is installed can be installed and operated in a similar manner to an FE type combustion device. Moreover, it is possible to prevent leakage of the combustion exhaust gases to the interior of the building in which the combustion device is installed, since it is possible to send any combustion exhaust gases that have leaked out from the exhaust conduit back to the air supply intake portion and to prevent the leaked exhaust gases from leaking to the exterior of the building.

In a preferable first aspect of the present invention, the combustion device comprises a combustion section and a heat exchange section and an air blower means for supplying air for combustion to the combustion section which are provided within the outer casing of the combustion device, and the air supply section supplies air to the air blower means, and the exhaust section discharges combustion exhaust gases after heat exchange, In a preferable second aspect of the present invention, a filter is provided to the air supply intake portion.

According to the second aspect, along with eliminating foreign matter within the air that is introduced into the combustion section, it is also possible to generate a negative gauge pressure in the air supply intake portion.

Thus, according to the present invention, it is possible to provide an air supply and exhaust adapter with which an FF type combustion device can be utilized in a safe manner by using an exhaust pipe that is already in existence, even in a location in which it is not possible to install an air supply pipe.

DETAILED DESCRIPTION

In the following, an embodiment of the present invention will be described on the basis of attached drawings. In the figures, the arrow U refers to the upward direction, the arrow F refers to the forward direction, and the arrow L refers to the leftward direction.

First, an FF type combustion device 1 will be explained.

Figure 1:
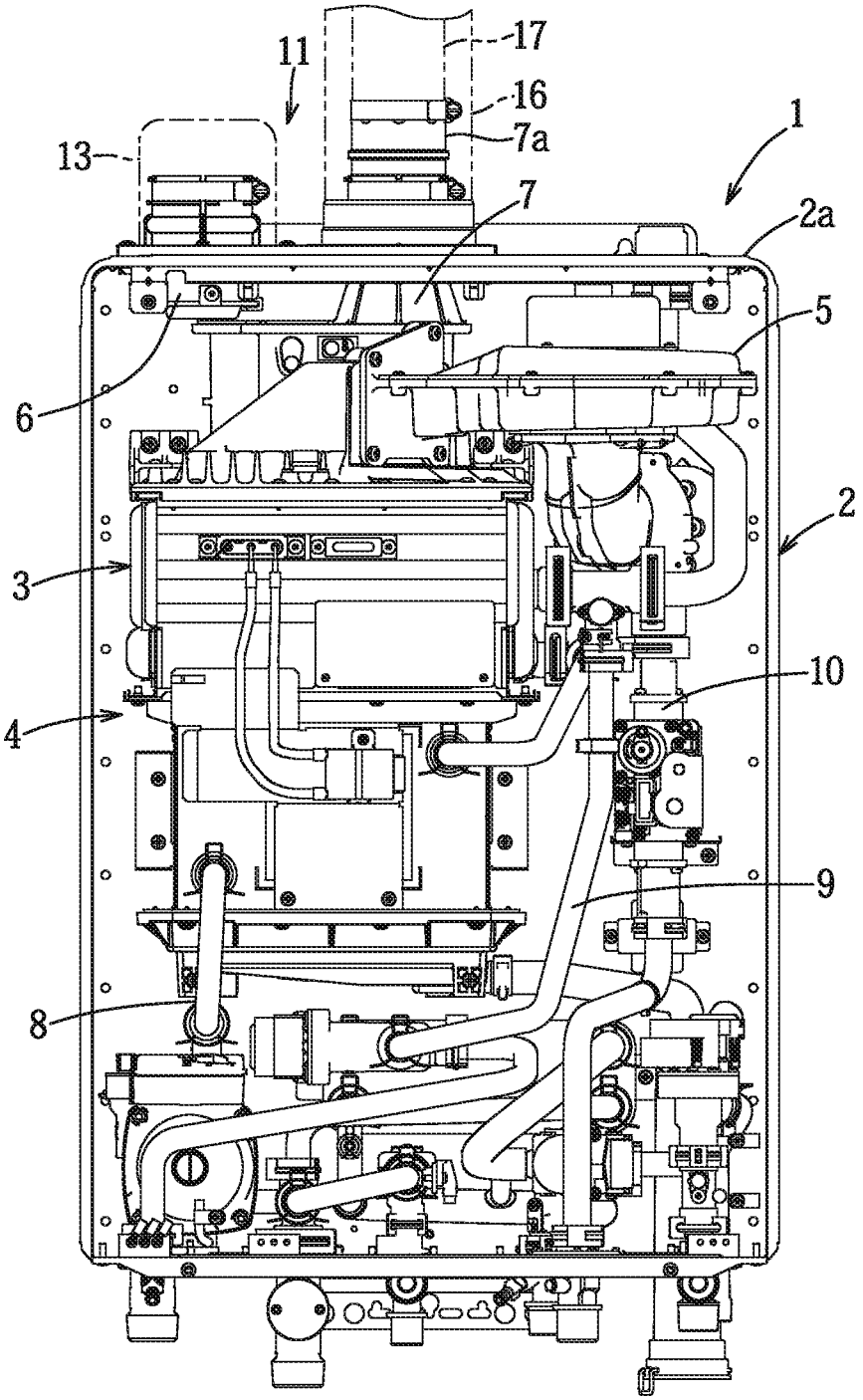
FIG. 1 is an elevation view of a combustion device that is equipped with an air supply and exhaust adapter according to an embodiment of the present invention.

As shown in FIG. 1, the combustion device 1 comprises a box shaped outer casing 2, and, in this outer casing 2, a combustion section 3, a heat exchange section 4, an air blower means 5, an air supply section 6, an exhaust section 7, and so on are installed. The air supply section 6 and the exhaust section 7 are disposed so that portions thereof project upward from the top plate portion 2*a* of the outer casing 2. The air blower means 5 supplies air taken into the outer casing 2 from the air supply section 6 to the combustion section 3 as air for combustion. The combustion section 3 combusts fuel supplied from a fuel supply conduit 10 together with the air for combustion, and thereby generates combustion exhaust gases. In the heat exchange section 4, these combustion gases exchange heat with fluid that flows in from an intake pipe 8. After heat exchange, the combustion gases are ejected from an exhaust section 7 as exhaust gases. And working fluid that has exchanged heat in the heat exchange section 4 with these combustion exhaust gases flows out through an outlet pipe 9.

Although this feature is omitted from the figure, normally, the air supply section 6 and the exhaust section 7 of the combustion device 1 are respectively connected to an air supply pipe and to an exhaust conduit, both of which communicate with the outdoors. Accordingly, normally the combustion device 1 takes in outdoor air with the air blower means 5 and combusts fuel, and exhausts combustion exhaust gases to the outdoors.

Next, an air supply and exhaust adapter 11 will be explained.

Figure 2:
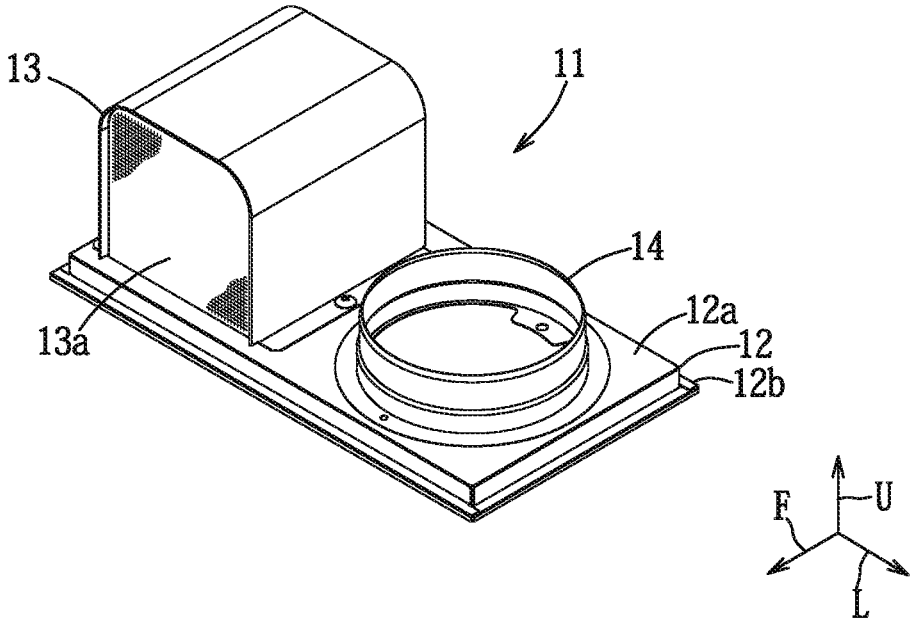
FIG. 2 is a perspective view of the air supply and exhaust adapter.
Figure 3:
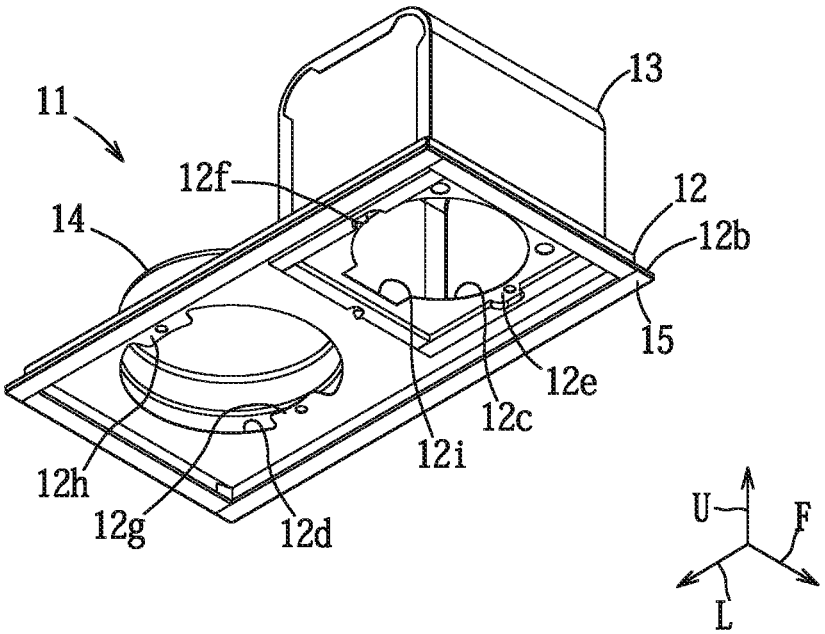
FIG. 3 is a perspective view of the air supply and exhaust adapter as seen from a viewing angle that is different from the viewing angle of FIG. 2.
Figure 4:
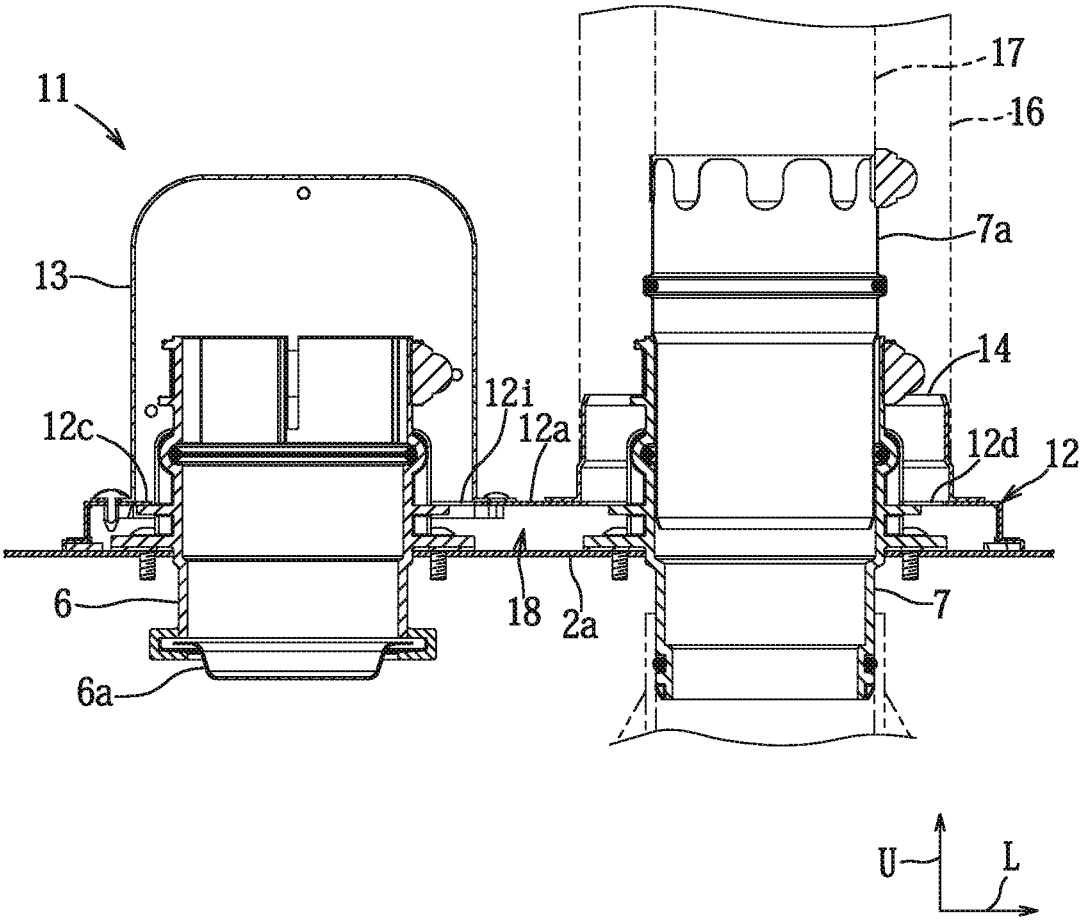
FIG. 4 is a sectional view of an intake section and an exhaust section of the combustion device to which the air supply and exhaust adapter is installed.

As shown in FIGS. 2 through 4, the air supply and exhaust adapter 11 comprises a base portion 12 that is formed in the shape of a box with its bottom surface portion open, an air supply intake portion 13 that is provided on a top surface portion 12*a* of the base portion 12, and a cylindrical circumferential wall portion 14. A flange portion 12*b* is formed along the external periphery of the bottom surface portion of the base portion 12, and a seal member 15 is disposed on the lower surface of the flange portion 12*b*, so that it can be secured to the top plate portion 2*a* of the outer casing 2 in an air-tight manner.

The top surface portion 12*a* is provided with an air supply opening portion 12*c* and an exhaust opening portion 12*d*, through which the air supply section 6 and the exhaust section 7 are respectively inserted, and air supply section fixing portions 12*e*, 12*f* and exhaust section fixing portions 12*g*, 12*h* are respectively provided to these opening portions and can be fixed by screws or the like to the air supply section 6 and the exhaust section 7 that are respectively inserted therethrough as described above. The air supply opening portion 12*c* is fitted over the air supply section 6 that is inserted therethrough. And a cutaway portion 12*i* is formed on the periphery of the air supply opening portion 12*c* on its side toward the exhaust opening portion 12*d*, and is cut away so that a clearance is established between that part of the periphery and the air supply section 6 that is inserted through the opening portion 12*c*.

The air supply intake portion 13 is formed in a box shape whose bottom portion is open, and is installed to the top surface portion 12*a* so as to cover the air supply section 6 that projects from the air supply opening portion 12*c*. A filter 13*a* formed as a mesh is provided at the front surface portion of the air supply intake portion 13. Foreign matter included in the air that is being sucked through this filter 13*a* into the air supply intake portion 13 is removed by the filter 13*a*.

The exhaust opening portion 12*d* is formed to have a diameter greater than the external diameter of the exhaust section 7. Exhaust section fixing portions 12*g*, 12*h* are formed to project radially inward from the edge of the exhaust opening portion 12*d*. Due to this, a gap is defined between the exhaust opening portion 12*d* and the exhaust section 7 that is inserted through it. The circumferential wall portion 14 is formed as a cylinder and follows the periphery of the exhaust opening portion 12*d*. The exhaust section 7 can be inserted through the interior of the circumferential wall portion 14, and a duct 16 described later can be connected to the circumferential wall portion 14.

Next, the installation of the combustion device 1 that employs this air supply and exhaust adapter 11 will be explained.

Figure 5:
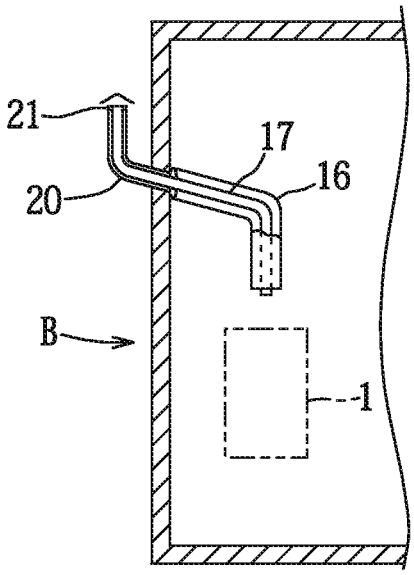
FIG. 5 is a schematic figure showing a building that is equipped with an exhaust pipe, with a combustion device being installed inside that building.

As shown in FIG. 5, a cylindrical exhaust pipe 20 is provided to a building B and communicates from the interior of the building B to its exterior. A duct 16 is connected to the end portion within the building B of the exhaust pipe 20, and an exhaust conduit 17 is inserted through the interiors of the exhaust pipe 20 and the duct 16. And, at the end portions of the exhaust pipe 20 and the exhaust conduit 17 exterior to the building B, a protective cap 21 for preventing intrusion of rain water or the like is installed between the exhaust pipe 20 and the exhaust conduit 17. The combustion device 1 is installed in this building B.

As shown in FIGS. 1 and 4, the base portion 12 is installed to the top plate portion 2*a* of the combustion device 1, and, along with the air supply section 6 being passed through the air supply opening portion 12*c* and being fixed by screws to the air supply section fixing portions 12*e*, 12*f* (not shown in the figure), also the exhaust section 7 is passed through the exhaust opening portion 12*d* and the circumferential wall portion 14 and is fixed by screws e to the exhaust section fixing portions 12*g*, 12*h* (also not shown in the figure). Subsequently, by attaching the air supply intake portion 13 which covers the air supply section 6 to the base portion 12, the fitting of the air supply and exhaust adapter 11 to the combustion device 1 is completed. A filter member 6*a* is installed to the lower end portion of the air supply section 6.

The exhaust section 7 is connected to the exhaust conduit 17 that passes through the interior of the exhaust pipe 20, and communicates with the exterior of the building B. Since the exhaust conduit 17 is to be passed through the exhaust pipe 20 which is already in existence, it is desirable for it to be a conduit member that is flexible, and for example to be made from a synthetic resin such as polypropylene or the like. In order to make the task of connecting the exhaust section 7 and the exhaust conduit 17 together simple and easy, an extension member 7*a* is installed in advance to the exhaust section 7 so as to elongate the portion of connection with the exhaust conduit 17 to a position higher than the circumferential wall portion 14, and the exhaust section 7 is connected to the exhaust conduit 17 via the extension member 7*a*.

The duct 16 that is connected to the exhaust pipe 20 is connected to the circumferential wall portion 14. The space between the exhaust pipe 20 and the exhaust conduit 17 communicates, via the space between the duct 16 and the exhaust conduit 17 and via the space between the circumferential wall portion 14 and the exhaust section 7, with a communication passage 18 that is defined within the base portion 12 between its top surface portion 12*a* and the top plate portion 2*a*. Via the cutaway portion 12*i*, the communication passage 18 communicates with the air supply intake portion 13. The duct 16 is a flexible duct that, for example, may be made by forming a sheet member in which a synthetic resin sheet and an aluminum sheet are laminated together into the form of a cylinder, together with reinforcing wire. Due to this construction, it is possible to bend the duct 16 and to form it to follow along the exhaust conduit 17 which is passed through it, while still maintaining the outer diameter of the duct 16.

Next, the operation and the beneficial effects of the air supply and exhaust adapter 11 of the present invention will be explained.

The air supply and exhaust adapter 11 is installed to the top plate portion 2*a* of the outer casing 2 of the combustion device 1. The circumferential wall portion 14 of the air supply and exhaust adapter 11 that surrounds the exhaust section 7 of the combustion device 1 is connected via the duct 16 to the exhaust pipe 20 which is already in existence. And the exhaust section 7 of the combustion device 1 is communicated with the exterior of the building B via the exhaust conduit 17 that is inserted through the interior of the exhaust pipe 20.

The space between the exhaust pipe 20 and the exhaust conduit 17 is blocked at their end portions exterior to the building B by the protective cap 21. This space is communicated to the air supply intake portion 13 by the communication passage 18 within the base portion 12 of the air supply and exhaust adapter 11, via the space between the duct 16 and the exhaust conduit 17 and the space between the circumferential wall portion 14 and the exhaust section 7. The communication passage 18 and the air supply intake portion 13 are communicated with one another through the cutaway portion 12*i*.

When the air blower means 5 is operated, air within the building B can be taken into the air supply intake portion 13 via the filter 13*a*, so that the air within the building B can be employed as the air supply for the combustion device 1. At this time, due to the ventilation resistance of the filter 13*a*, the pressure at the air supply intake portion 13 becomes negative with respect to the atmospheric pressure inside the building, and, via the communication passage 18, the gauge pressure in the space between the duct 16 and the exhaust conduit 17 also becomes negative. Even if combustion exhaust gases leak from the exhaust conduit 17 into this space, it is possible to prevent leakage of these gases to the interior of the building B, since these leaked exhaust gases are taken into the combustion device 1 for a second time via the communication passage 18 and are then discharged to the exterior of the building B through the exhaust section 7 and the exhaust conduit 17. Accordingly, even if it is not possible to provide an air supply pipe that communicates with the exterior of the building B, with this air supply and exhaust adapter 11, it is possible to install the combustion device 1 in the interior of the building B by utilizing the exhaust pipe 20 which is already in existence, and it is possible to utilize this combustion device 1 in a safe manner.

The combustion device 1 explained above is capable of serving as a hot water supply device and/or a room heating device, and can be built so that heat is supplied by the heat exchange section 4 to hot water and/or to a room heating thermal medium. Apart from the above, for a person skilled in the art, it would be possible, without deviating from the gist of the present invention, to implement the present invention in various forms by making additions of various types to the embodiment described above, and the present invention is to be considered as encompassing modifications of this kind.

The invention claimed is:

1. An air supply and exhaust adapter for a combustion device of a forced air supply and exhaust type, with the combustion device comprising an air supply section for supplying air to air blower means and an exhaust section connected with an exhaust conduit, which are provided to project from a top plate portion of an outer casing; comprising a base portion that comprises a box shaped configuration and an open bottom portion, an air supply intake portion that is formed on a top surface portion of the base portion so as to cover the air supply section and that moreover takes in air from a surroundings of the combustion device, a circumferential wall portion that surrounds a periphery of the exhaust section and is connected with a duct in which the exhaust conduit is inserted; and a communication passage defined between the top surface portion and the top plate portion so as to communicate a space between the exhaust section and the circumferential wall portion with the air supply intake portion;

the communication passage being constructed so that, due to an operation of the air blower means, a gauge pressure therein becomes negative.

2. The air supply and exhaust adapter for a combustion device according to claim 1; wherein the combustion device comprises a combustion section and a heat exchange section and the air blower means for supplying air for combustion to the combustion section which are provided within the outer casing of the combustion device, and the air supply section supplies air to the air blower means, and the exhaust section discharges combustion exhaust gases after heat exchange.

3. The air supply and exhaust adapter for a combustion device according to claim 1, wherein a filter is provided to the air supply intake portion.

* * * * *